US007794337B2

(12) United States Patent
Gamboa

(10) Patent No.: US 7,794,337 B2
(45) Date of Patent: Sep. 14, 2010

(54) TACKLING DUMMY

(75) Inventor: Ricardo Gamboa, Monterey Park, CA (US)

(73) Assignee: BORG Unlimited Inc., Monterey Park, CA (US)

( * ) Notice: Subject to any disclaimer, the term of this patent is extended or adjusted under 35 U.S.C. 154(b) by 155 days.

(21) Appl. No.: 11/943,086

(22) Filed: Nov. 20, 2007

(65) Prior Publication Data

US 2008/0119306 A1 May 22, 2008

Related U.S. Application Data

(60) Provisional application No. 60/866,467, filed on Nov. 20, 2006.

(51) Int. Cl.
*A63B 69/34* (2006.01)
*A63B 69/00* (2006.01)

(52) U.S. Cl. ..... 473/441; 473/445; 473/438

(58) Field of Classification Search ..... 473/422, 473/438, 440–445; 482/83–90, 142
See application file for complete search history.

(56) References Cited

U.S. PATENT DOCUMENTS

| | | | | |
|---|---|---|---|---|
| 1,962,088 | A | 6/1934 | Crowther | |
| 2,237,600 | A | 4/1941 | Gilman | |
| 2,620,188 | A | 12/1952 | Malagio | |
| 2,929,629 | A | 3/1960 | Feula | |
| 2,934,343 | A | 4/1960 | Schumacher | |
| 3,216,724 | A * | 11/1965 | Williams | 473/445 |
| 3,649,016 | A * | 3/1972 | Kelley, Jr. | 473/441 |
| 3,997,160 | A * | 12/1976 | George | 473/444 |
| 5,090,696 | A | 2/1992 | Forrest, Sr. | |
| 6,183,399 | B1 * | 2/2001 | Chen | 482/90 |
| 6,309,327 | B1 * | 10/2001 | Hallberg | 482/83 |
| 6,458,051 | B1 * | 10/2002 | Moore | 473/445 |
| 6,988,965 | B2 * | 1/2006 | Krause | 473/445 |
| 7,070,521 | B2 * | 7/2006 | Bayduke | 473/438 |
| 7,131,917 | B2 * | 11/2006 | Spencer | 473/444 |
| 7,322,893 | B2 * | 1/2008 | Bright | 473/441 |
| 7,357,760 | B1 * | 4/2008 | Rios | 482/90 |
| 7,527,568 | B2 * | 5/2009 | Joseph | 473/441 |
| 2006/0100040 | A1 * | 5/2006 | Spencer | 473/441 |

* cited by examiner

*Primary Examiner*—Mitra Aryanpour
(74) *Attorney, Agent, or Firm*—Kelly Lowry & Kelley, LLP

(57) ABSTRACT

The tackling dummy includes a slide having a ground-engaging skid and an upward extending frame configured to receive a channel formed in an anthropomorphic body having a front side and a relatively narrower profile side. The channel extends upwardly into the anthropomorphic body from a lower side thereof and engages the upwardly extending frame for positioning the anthropomorphic body in one of two primary configurations relative to the slide. These configurations are rotationally spaced about the longitudinal axis of the channel approximately 90° from one another.

13 Claims, 3 Drawing Sheets

EXHIBIT G

EXHIBIT G

EXHIBIT G

TACKLING DUMMY

BACKGROUND OF THE INVENTION

The present invention is generally directed to a tackling practice device. More particularly, the present invention is directed to an anthropomorphic tackling dummy having a channel for positioning the tackling dummy in multiple positions rotationally relative to one another.

Tackling and blocking are some of the most important skills in football. A successful tackle can prevent a player on an opposing football team in possession of the football from scoring a touchdown. A successful block can prevent a member of an opposing team from being able to reach and tackle a quarterback while still in possession of the football prior to a throw. Tackling practice devices are well-known in the art and are designed to be used for the purpose of allowing a football athlete to practice both tackling and blocking techniques. A conventional tackling practice device, such as those described in U.S. Pat. Nos. 1,962,088 and 2,237,600, generally includes a frame having a padded surface on an upright portion.

Conventional tackling devices, such as those described above, have certain disadvantages. For example, the padded surface may be nothing more than a padded rectangular block that fails to simulate an anthropomorphic shape. Even if the padded surface is in an anthropomorphic shape, the padded surface cannot be adjusted to simulate the stance of an opposing player in anything other than a frontal configuration.

Various attempts have been made to overcome the problems associated with conventional tackling machines. For example, U.S. Pat. No. 2,620,188 discloses a resilient bag support having a frame with two skids, an upright structure and a pad resiliently mounted on a coil spring. While this tackling machine may simulate the actual reaction a player encounters when contacting an opponent in an actual game, the bag is non-anthropomorphic. The generally cylindrical shape of the bag does little to simulate the actual body of an opponent. In another example, U.S. Pat. No. 3,216,724 discloses a football practice apparatus. This apparatus only includes padded dummies in a fixed orientation suitable only for simulating an opponent in a frontal configuration. In an additional example, U.S. Pat. No. 5,090,696 discloses a pop-up tackling practice machine. While this apparatus includes a padded dummy simulating an anthropomorphic shape, the dummy is in a fixed orientation suitable only for simulating an opponent in a frontal configuration.

Accordingly, there is a need for a tackling apparatus having a dummy simulating an anthropomorphic shape. There is a further need for a tackling apparatus having a dummy that is adjustable into both frontal and sideways configurations. The present invention fulfills these needs and provides other related advantages.

SUMMARY OF THE INVENTION

The tackling dummy of the present invention includes a slide having a ground-engaging skid and an upwardly extending frame configured for slide-fit engagement with a channel extending upwardly into an anthropomorphic body having a front side and a relatively narrower profile side. The channel is configured to position the anthropomorphic body into one of two primary configurations relative to the slide. These configurations are rotationally spaced about the longitudinal axis of the channel approximately 90° from one another. Preferably, the anthropomorphic body includes a pad comprising foam, rubber or gel similar to that of football pads or other football gear. It is also preferable that the anthropomorphic body be angled between 45° and 90° when engaged to the frame.

The frame is a substantially rectangular member comprising a lower portion connected to the slide, an angled intermediate portion and an upwardly extending top section for receiving the channel. In one embodiment, the channel is X-shaped and preferably configured for slide-fit engagement with the frame.

Furthermore, the tackling dummy of the present invention may further include a strap extending from the lower side of the anthropomorphic body. The strap restricts vertical travel of the anthropomorphic body while engaged with the frame. The strap effectively prevents detachment of the anthropomorphic body from the frame during use. Accordingly, it is preferable that the strap be adjustable. A clip selectively connected to the strap secures the anthropomorphic body to the frame when the anthropomorphic body is in use. Detachment of the clip enables the anthropomorphic body to be removed and reconfigured on the upwardly extending frame of the slide. Preferably, the anthropomorphic body comprises plastic, metal or a polymeric composite.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

As shown in the figures for purpose of illustration, the present invention resides in a tackling machine having a dummy in an anthropomorphic shape and adjustable between a front and profile configuration.

Figure 1:
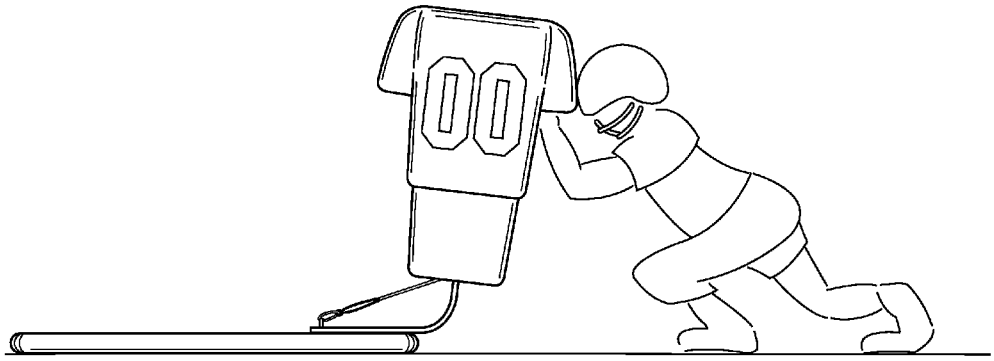
FIG. 1 is a side elevation view of a tackling dummy embodying the present invention, illustrating using the dummy for tackling practice.
Figure 2:
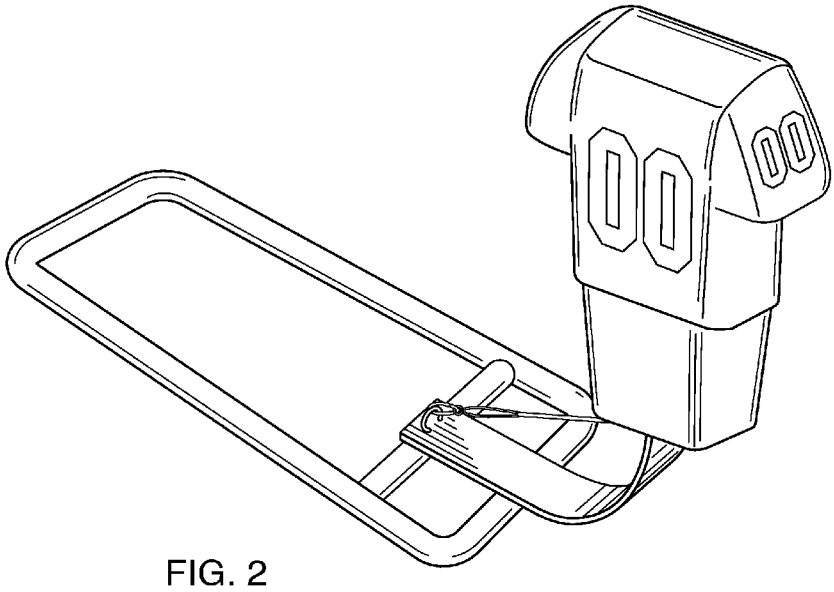
FIG. 2 is a perspective view of the tackling dummy of FIG. 1, illustrating the dummy in a sideways configuration.

With reference to FIG. 1, the tackling dummy 10 includes a generally rectangular sled or frame 12 and an upright dummy support 14 upon which a dummy 16 is removably mounted. The frame 12 includes a pair of tubular side members 18, 20, a tubular rear end member 22, a tubular front end member 24 and a tubular lateral support member 26. The lateral support member 26 is connected to the frame 12 between the side members 18, 20, toward the front end member 24.

The upright dummy support 14 has a narrow generally rectangular member with a corresponding rectangular cross-section. The upright dummy support 14 is made of a suitably resilient material (e.g., metal, plastic, composite material, or the like) for simulating the actual reaction a player encounters when contacting an opponent in an actual game. The upright dummy support 14 resists impact and returns energy from the impact back to the player. The upright dummy support 14 is preferably connected to the frame 12 and the lateral support 26. The upright dummy support 14 extends away from the frame 12, bending between forty-five to ninety degrees relative to a horizontal surface 28 (FIG. 1) upon which the frame 12 rests. The tubular members 18, 20, 22, 24 of the frame 12 may be made of a single tube bent into the configuration best shown in FIGS. 2-6 and may be made of a suitable material such as metal, plastic, a composite material or the like. The lateral support member 26 may be suitably attached to the frame 12 by various mechanisms including, but not limited to, mechanical fasteners (e.g., bolts, screws or the like), welding or a combination thereof. Alternatively, the side members 18, 20 may angle upward toward the rear end member 22 of the frame 12 by the rear end member 22 relative to the horizontal surface 28 upon which the frame 12 rests. The upturned end is designed to prevent the tackling dummy 10 from plowing into the ground when the frame 12 is moved by a player during tackling practice.

Figure 3:
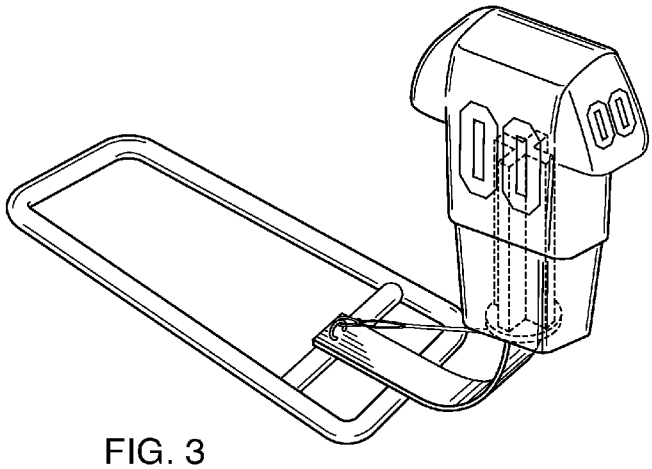
FIG. 3 is another perspective view of the tackling dummy of FIG. 1, illustrating an internal dummy positioning mechanism.
Figure 4:
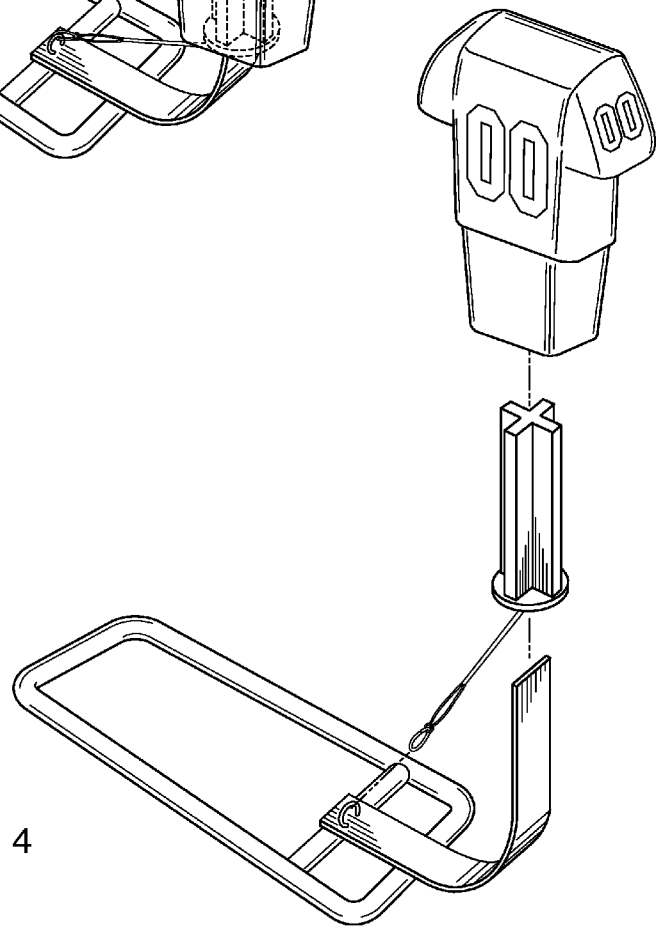
FIG. 4 is an exploded perspective view of the tackling dummy of FIG. 2.

The dummy 16 is an anthropomorphic padded frame 30. The padding material may include foam, rubber, gel and other materials designed to simulate the feel of a human body. The anthropomorphic padded frame 30 is designed to resemble the torso of a human, including a lower body portion 32, an upper body portion 34 and two laterally extending arm/shoulder portions 36. The padded frame 30 includes a generally cylindrical internal recess (not shown) on a lower end thereof into which an interconnecting mechanism 38 may be inserted and secured therein. The interconnecting mechanism 38 is designed to allow the dummy 16 to be removably mounted to the upright dummy support 14 in both frontal (FIG. 6) and sideways (FIG. 2) configurations. The dummy 16 is slidably received by the interconnecting mechanism 38 and thereafter received by the upright dummy support 14 by sliding a free end 40 of the interconnecting mechanism 38 thereover. A strap 52, as best shown in FIGS. 3-4, is connected to the base of the interconnecting mechanism 38 to prevent inadvertent detachment of the interconnecting mechanism 38 from the upright dummy support 14 during use of the tackling dummy 10. A looped end 54 of the strap 52 is connected to a retaining ring 56. The retaining ring 56 is mounted to the bottom of the upright dummy support 14 via a connector 58. When the connector 58 is engaged to the retaining ring 56 and the looped end 54 of the strap 52 (FIG. 3), the vertical travel distance of the interconnecting mechanism 38 along the free end 40 of the upright dummy support 14 is accordingly restricted to prevent detachment of the interconnecting mechanism 38 from the upright dummy support 14. The connector 58 is disengaged from the retaining ring 56 when the interconnecting mechanism 38 is to be removed from the upright dummy support 14, as illustrated in exploded form in FIG. 4.

Figure 5:
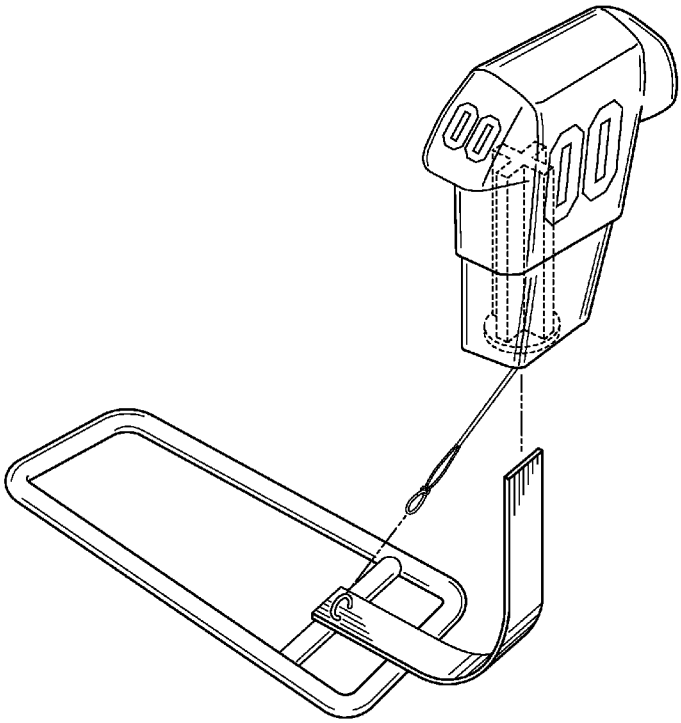
FIG. 5 is a partially exploded perspective view of the tackling dummy of FIG. 1, illustrating the dummy in a frontal configuration.
Figure 6:
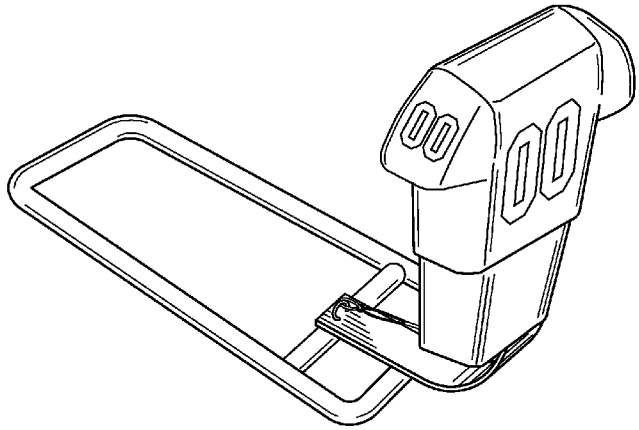
FIG. 6 is a perspective view of the tackling dummy of FIG. 5.

The interconnecting mechanism 38 comprises a receptacle 42 including two intersecting generally rectangular channels 44 that fit into an X-shaped recess formed in the dummy 16. The channels 44 are connected to an annular plate 46 having an X-shaped aperture (not shown) through which the free end 40 of the upright dummy support 14 can be inserted. A front side 48 of the dummy 16 is aligned with one channel 44 of the X-shaped recess and a pair of profile sides 50 of the dummy 16 are aligned with the other channel 44 of the X-shaped recess. In this manner, the dummy 16 can be lowered onto the free end 40 of the upright dummy support 14. Accordingly, the free end 40 enters a selected rectangular channel 44 such that the dummy 16 can be positioned in either a sideways configuration (FIG. 2) or a frontal configuration (FIG. 5). The recess may also come in a variety of other cross-sectional shapes (e.g., ovoid, rectangular, square or the like) or a combination of such shapes with the cross-section of the free end 40 shaped accordingly.

A fitted detachable jersey may also be attached to the dummy 16 to simulate the team colors of an opposing team.

Although an embodiment has been described in detail for purposes of illustration, various modifications may be made without departing from the scope and spirit of the invention. Accordingly, the invention is not to be limited, except as by the appended claims.

What is claimed is:

1. An tackling dummy, comprising:

a slide including a ground-engaging skid and an upwardly extending frame; and an anthropomorphic body having a front side, a relatively narrower profile side, and a X-shaped channel extending upwardly into the anthropomorphic body from a lower side thereof, the channel being configured to selectively receive the frame for positioning the anthropomorphic body into one of two primary configurations relative to the slide, wherein said configurations are rotationally spaced about the longitudinal axis of the channel approximately ninety degrees from one another, wherein the anthropomorphic body is disposed at an angle between forty-five and ninety degrees from horizontal when attached to the frame.

2. The tackling dummy of claim 1, wherein the anthropomorphic body includes a pad comprising foam, rubber or gel.

3. The tackling dummy of claim 2, wherein the anthropomorphic body comprises a plastic, metal or polymeric composite base overlaid by the pad.

4. The tackling dummy of claim 1, wherein the channel is configured for slide-fit engagement with the frame.

5. The tackling dummy of claim 1, including a strap extending from the lower side of the anthropomorphic body, for preventing detachment of the anthropomorphic body from the frame during tackling.

6. The tackling dummy of claim 5, wherein the strap is adjustable.

7. The tackling dummy of claim 5, including a clip selectively connected to the strap for securely connecting the anthropomorphic body to the frame.

8. An tackling dummy, comprising:

a slide including a ground-engaging skid and an upwardly extending frame;

an anthropomorphic body having a front side, a relatively narrower profile side, and a X-shaped channel extending upwardly into the anthropomorphic body from a lower side thereof, the channel configured to selectively receive the frame by slide-fit engagement for positioning the anthropomorphic body into one of two primary configurations relative to the slide, wherein said configurations are rotationally spaced about the longitudinal axis of the channel approximately ninety degrees from one another; and a strap extending from the lower side of the anthropomorphic body, for preventing detachment of the anthropomorphic body from the frame during tackling, wherein the anthropomorphic body is disposed at an angle between forty-five and ninety degrees from horizontal when attached to the frame.

9. The tackling dummy of claim 8, wherein the anthropomorphic body includes a pad comprising foam, rubber or gel.

10. The tackling dummy of claim 9, wherein the anthropomorphic body comprises a plastic, metal or polymeric composite base overlaid by the pad.

11. The tackling dummy of claim 8, wherein the strap is adjustable.

12. The tackling dummy of claim 8, including a clip selectively connected to the strap for securely connecting the anthropomorphic body to the frame.

13. An tackling dummy, comprising:

a slide including a ground-engaging skid and an upwardly extending frame;

an anthropomorphic body comprising a plastic, metal or polymeric composite base overlaid by a pad comprising foam, rubber or gel, the anthropomorphic body having a front side, a relatively narrower profile side, and a X-shaped channel extending upwardly into the anthropomorphic body from a lower side thereof, the channel configured to selectively receive the frame by slide-fit engagement for positioning the anthropomorphic body into one of two primary configurations relative to the slide, wherein said configurations are rotationally spaced about the longitudinal axis of the channel approximately ninety degrees from one another;

an adjustable strap extending from the lower side of the anthropomorphic body, for preventing detachment of the anthropomorphic body from the frame during tackling; and a clip selectively connected to the strap for securely connecting the anthropomorphic body to the frame, wherein the anthropomorphic body is disposed at an angle between forty-five and ninety degrees from horizontal when attached to the frame.

* * * * *